US008668460B2

(12) United States Patent
Han et al.

(10) Patent No.: US 8,668,460 B2
(45) Date of Patent: Mar. 11, 2014

(54) TURBO FAN AND AIR CONDITIONER WITH TURBO FAN

(75) Inventors: Sungwon Han, Changwon-si (KR); Inho Choi, Changwon-si (KR); Kyunghwan Kim, Changwon-si (KR); Kidong Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 602 days.

(21) Appl. No.: 13/030,920

(22) Filed: Feb. 18, 2011

(65) Prior Publication Data

US 2012/0055656 A1 Mar. 8, 2012

(30) Foreign Application Priority Data

Sep. 2, 2010 (KR) ..... 10-2010-0086156

(51) Int. Cl.
*F04D 29/38* (2006.01)

(52) U.S. Cl.
USPC ..... 416/241 R; 416/223 A

(58) Field of Classification Search
None
See application file for complete search history.

(56) References Cited

U.S. PATENT DOCUMENTS

| | | | | |
|---|---|---|---|---|
| 6,508,630 | B2 * | 1/2003 | Liu et al. | 416/228 |
| 6,558,120 | B2 | 5/2003 | Kim et al. | |
| 7,191,613 | B2 | 3/2007 | Lee | |
| 2010/0202886 | A1 | 8/2010 | Iwata et al. | |

FOREIGN PATENT DOCUMENTS

| | | |
|---|---|---|
| DE | 20319741 | 10/2004 |
| FR | 456090 | 8/1913 |
| GB | 464449 | 4/1937 |
| WO | WO 2010/143341 | 12/2010 |

* cited by examiner

*Primary Examiner* — Edward Look
*Assistant Examiner* — Aaron R Eastman
(74) *Attorney, Agent, or Firm* — McKenna Long & Aldridge LLP

(57) ABSTRACT

A turbo fan includes a main plate for rotation in a rotational direction about a rotational axis and a plurality of blades arranged at intervals around the rotational axis of the main plate. At least one blade includes: a first blade section having a leading end and a trailing end; a second blade section having a leading end and a trailing end, wherein the first blade section is between the main plate and the second blade section; and a third blade section having a leading end and a trailing end, wherein the third blade section is between the first blade section and the second blade section.

18 Claims, 5 Drawing Sheets

TURBO FAN AND AIR CONDITIONER WITH TURBO FAN

CROSS-REFERENCE TO RELATED APPLICATION

This application claims priority from Korean Patent Application No. 10-2010-0086156, filed on Sep. 2, 2010 in the Korean Intellectual Property Office, the entire contents of which are incorporated herein by reference for all purposes as if fully set forth herein.

BACKGROUND OF THE INVENTION

1. Field of the Invention

Exemplary embodiments of the present invention relate to a turbo fan and an air conditioner.

2. Description of the Related Art

Generally, air-blowing fans are widely used for forcibly blowing air by rotational force of a rotor or an impeller in refrigerators, air conditioners, and cleaners. Particularly, air-blowing fans are divided into axial flow fans, sirocco fans, and turbo fans according to how air is suctioned and discharged and their configuration.

Turbo fans adopt a method of suctioning air in an axial direction of the fan and discharging the air in a radial direction through spaces between the blades, that is, a side portion of the fan. In this case, since air is naturally suctioned into the fan, a duct is not required. Accordingly, turbo fans are widely applied to relatively large-sized products such as air conditioners of the ceiling-mounted type.

However, in order to increase the positive pressure from a related art turbo fan, the length of the blade has to be increased. If the length of the blade increases, an interval between the leading ends of the blades into which air is suctioned may be narrowed, and the amount of air suctioned between the blades may be reduced. As a result, there happens a problem that the airflow blown by the turbo fan is reduced.

SUMMARY OF THE INVENTION

Accordingly, the present invention is directed to a turbo fan and air conditioner that substantially obviate one or more problems due to limitations and disadvantages of the related art.

An advantage of the present invention is to provide a turbo fan that may secure a enough amount of airflow and increase positive pressure in the blade of the fan.

Another advantage of the present invention is to provide a turbo fan that may increase a contact area with air without increasing the length of a blade.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a turbo fan includes: a main plate for rotation in a rotational direction about a rotational axis; and a plurality of blades arranged at intervals around the rotational axis of the main plate. At least one blade may include: a first blade section having a leading end and a trailing end; a second blade section having a leading end and a trailing end, wherein the first blade section is between the main plate and the second blade section; and a third blade section having a leading end and a trailing end, wherein the third blade section is between the first blade section and the second blade section, wherein the leading end of the third blade section may be disposed more towards a negative pressure side of the blade than the leading end of the first blade section, and wherein the trailing end of the first blade section may be disposed more towards the rotational direction than the trailing end of the second blade section.

In another aspect of the present invention, a turbo fan includes: a main plate for rotation in a rotational direction about a rotational axis; and a plurality of blades arranged at intervals around the rotational axis of the main plate. At least one blade includes: a first blade section having a leading end and a trailing end; a second blade section having a leading end and a trailing end, wherein the first blade section is between the main plate and the second blade section; and a third blade section having a leading end and a trailing end, wherein the third blade section is between the first blade section and the second blade section, wherein the leading end of the third blade section is disposed more towards a negative pressure side of the blade than the leading ends of the first blade section and the second blade section, and wherein the trailing end of the third blade section is disposed between the trailing end of the first blade section and the trailing end of the second blade section in the rotational direction.

In still another aspect of the present invention, an air conditioner includes: a housing; a turbo fan in the housing; and a motor for driving the turbo fan, a heat exchanger at a discharge area of the turbo fan, wherein the turbo fan includes: a main plate for rotation in a rotational direction about a rotational axis; and a plurality of blades arranged at intervals around the rotational axis of the main plate, at least one blade including: a first blade section having a leading end and a trailing end; a second blade section having a leading end and a trailing end, wherein the first blade section is between the main plate and the second blade section; a third blade section having a leading end and a trailing end, wherein the third blade section is between the first blade section and the second blade section, wherein the leading end of the third blade section is disposed more towards a negative pressure surface side of the blade than the leading end of the first blade section, and wherein the trailing end of the first blade section is disposed more towards the rotational direction than the trailing end of the second blade section.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which is illustrated in the accompanying drawings. Wherever possible, the same reference numbers will be used throughout the drawings to refer to the same or like parts.

Figure 1:
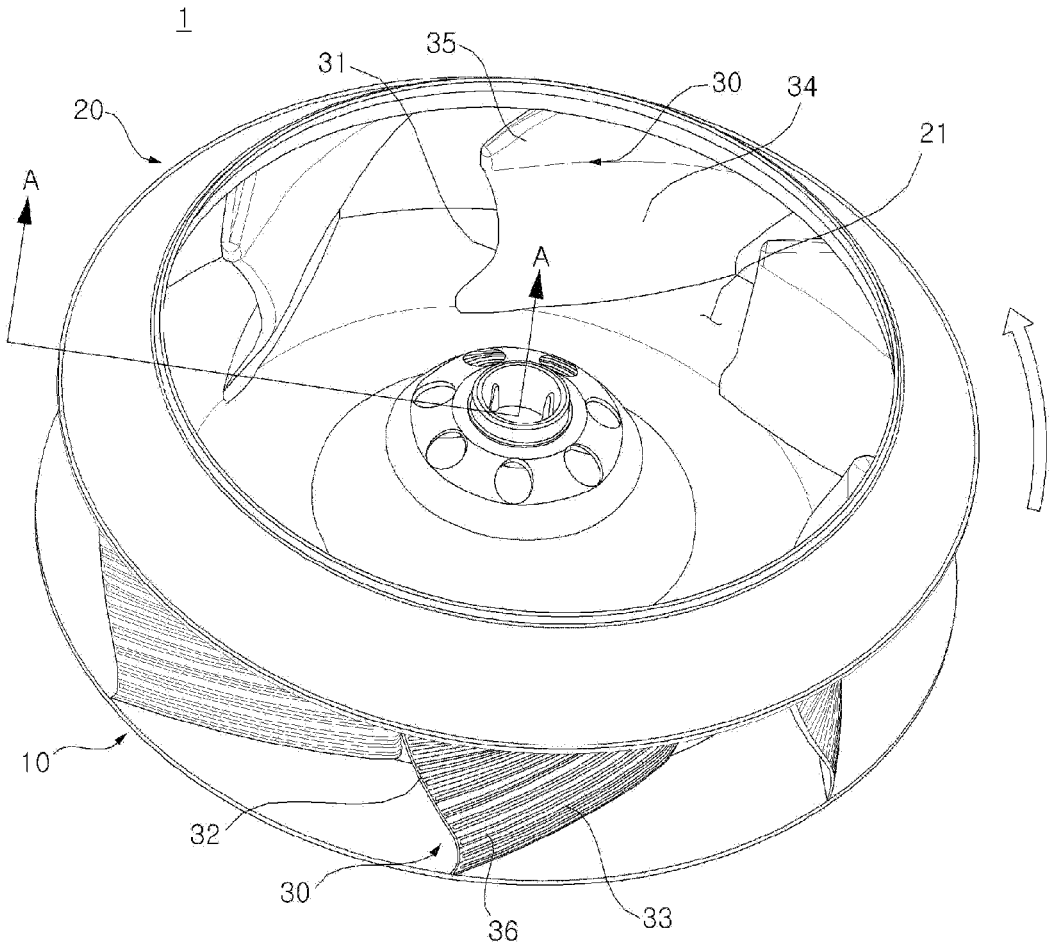
FIG. 1 is a perspective view illustrating a turbo fan according to an embodiment of the present invention.
Figure 2:
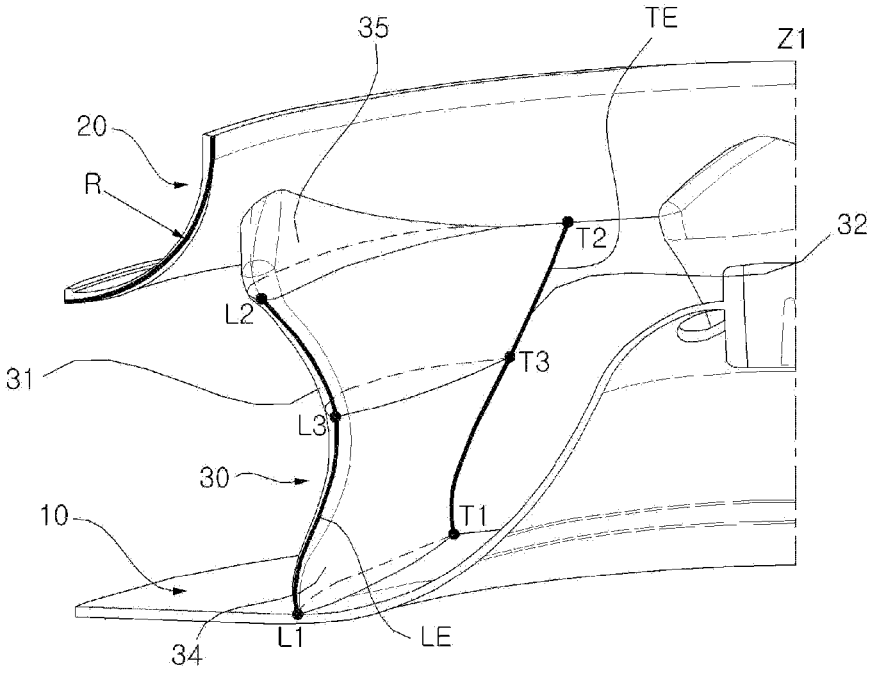
FIG. 2 is a view taken along line A-A of FIG. 1.
Figure 3:
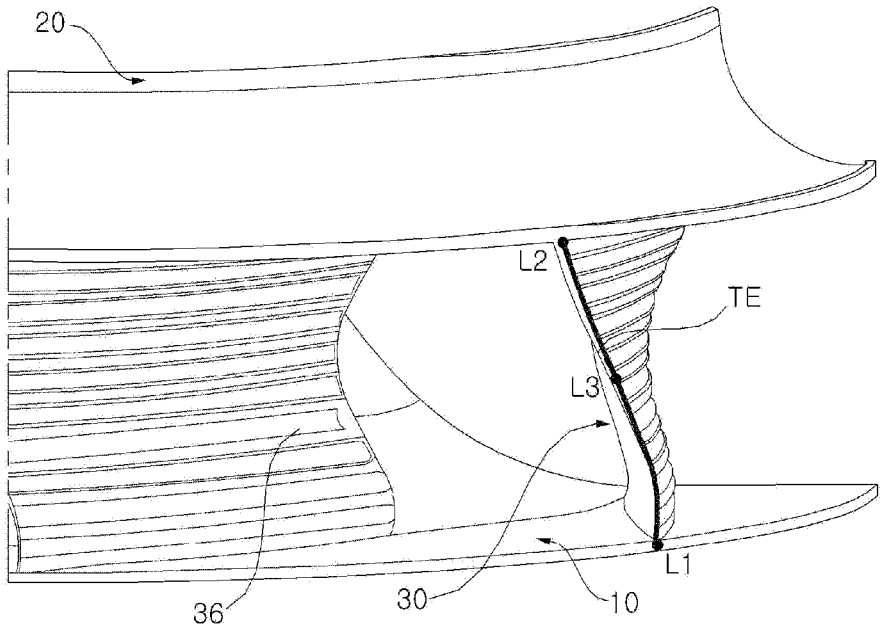
FIG. 3 is a partially magnified view illustrating a trailing edge of a blade shown in FIG. 1.
Figure 4:
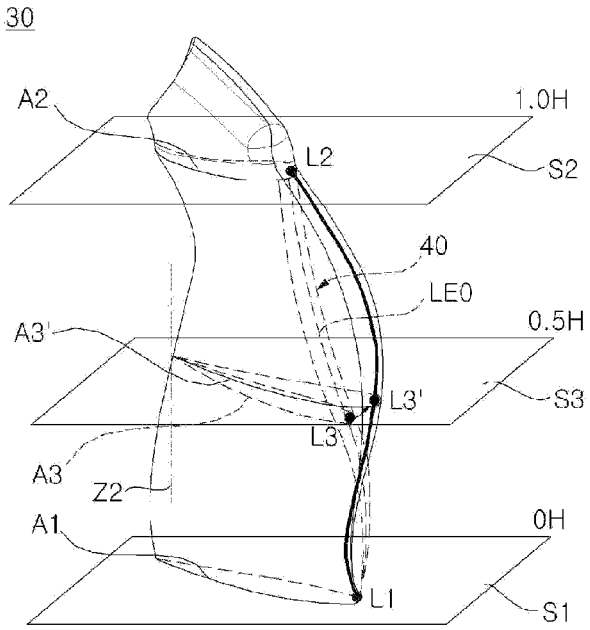
FIG. 4 is perspective view illustrating a blade of FIG. 1.
Figure 5:
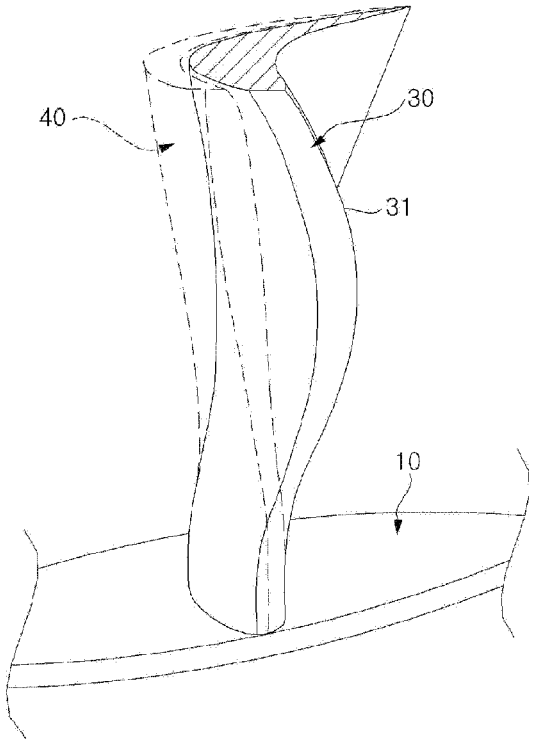
FIG. 5 is a perspective view illustrating a blade of FIG. 1, comparing the blade with a blade of a comparative embodiment.
Figure 6:
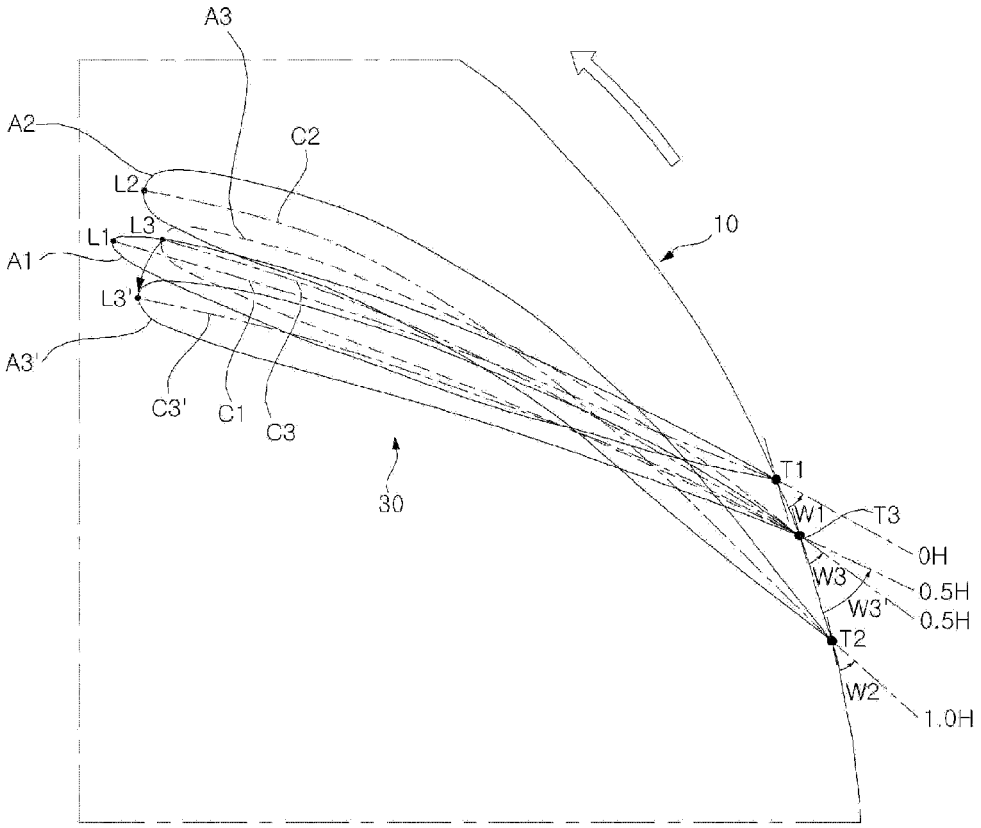
FIG. 6 is a projective view illustrating a sectional shape of a blade at each parallel surface of FIG. 4.

FIG. 1 is a perspective view illustrating a turbo fan according to an embodiment of the present invention. FIG. 2 is a view taken along line A-A of FIG. 1. FIG. 3 is a partially magnified view illustrating a trailing edge of a blade shown in FIG. 1. FIG. 4 is perspective view illustrating a blade of FIG. 1. FIG. 5 is a perspective view illustrating a blade of FIG. 1, comparing the blade with a blade of a comparative embodiment. FIG. 6 is a projective view illustrating a sectional shape of a blade at each parallel surface of FIG. 4.

Referring to FIGS. 1 through 3, a turbo fan 1 may include a main plate 10 rotated by a motor providing rotational force, a plurality of blades 30 having ends connected to the main plate 10 and disposed on the main plate 10 at certain intervals along a circumferential direction, and a ring-shaped shroud 20 facing the main plate 10 and connected to the other ends of the blades 30, and having an inlet 21 at the center to allow air to flow in upon rotation.

As the turbo fan 1 rotates, air suctioned through the inlet 21 of the shroud 20 may flow between leading edges 31 of the blades 30, and may be pressurized by pressure applied from the positive pressure surface 33 of the blade 30, and then may be discharged in a radial direction between trailing edges 32 of the blades 30.

Referring to FIGS. 1 through 6, when the blade 30 is cut at a plane parallel to the main plate 10, the cross-section may form an aerofoil shape. Here, the aerofoil refers to a streamlined wing developed by the National Advisory Committee for Aeronautics (NACA) in 1950.

Hereinafter, to define both surfaces of the blade 30, one surface facing a rotational direction of the turbo fan 1 may be defined as a positive pressure surface 33 to which a pressure greater than atmospheric pressure is applied, and the other surface opposite to the positive pressure surface 33 may be defined as a negative pressure surface 34 to which a pressure lower than atmospheric pressure is applied.

The blade 30 may be disposed to be biased in the opposite direction to the rotational direction of the turbo fan 1, forming an oblique line from the leading edge 31 of the blade 30 to the trailing edge 32 of the blade 30. Here, an angle between the trailing edge 32 of the blade 30 and a circumferential tangent line of the main plate 10 may be defined as a wing angle. More specifically, in a blade having an aerofoil shape at a cross-section thereof, the wing angle may be defined as an angle between an extending line of a camber line c of the aerofoil and a tangent line passing the trailing end of the aerofoil (refer to W1, W2, W3, and W3' of FIG. 6).

Here, the camber line refers to a curve that connects halfway points between a curve pertaining to the positive pressure surface 33 and a curve pertaining to the negative pressure surface 34 in an aerofoil shape obtained by horizontally cutting the blade 30. Given a function Zc(x) forming the camber line and a thickness function T(x) in the aerofoil shape, a function Z1($x$) of the curve pertaining to the positive pressure surface 33, and a function Z2($x$) of the curve pertaining to the negative pressure surface 34 may be defined as follows:

$$Z1(x)=Zc(x)+\tfrac{1}{2}T(x)$$

$$Z2(x)=Zc(x)-\tfrac{1}{2}T(x),$$

where x is coordinates taken along a chord obtained by connecting the leading end and the trailing end of an aerofoil in a straight line.

On the other hand the shroud 20 may be formed to have an inner side surface formed with a curved surface having a certain curvature R such that air suctioned through the inlet 21 may smoothly flow into a circumferential edge side of the shroud 20. Also, the blade 30 may include a shroud connection portion 35 having an end portion having a curved surface and coupled to the shroud 20 corresponding to the inner side surface of the shroud 20 forming the curved surface.

The leading edge 31 of the blade 30 may be formed to be convex to the direction of the negative pressure surface 34. Accordingly, an area of the positive pressure surface 33 may be broadened, thereby facilitating a positive pressure rise.

Hereinafter, the shape of the blade 30 applied to the turbo fan 1 will be defined through a process for forming the same. The sectional shape of the blade 30 will be described as being an aerofoil. However the section shape of the blade 30 may have a non-aerofoil shape.

A first blade section A1 having a certain aerofoil shape may be formed on the main plate 10. A first parallel surface S1 shown in FIG. 4 may be an equipotential surface to the upper surface of the main plate 10. A wing angle of the first blade section A1 may become an angle W1 between a camber line C1 of the first blade section A1 and a tangent line passing the trailing end T1 of the first blade section A1 and contacting the circumference of the main plate 10.

A second blade section A2 having a certain aerofoil shape may be formed on a second parallel surface S2 spaced from the main plate 10 by a certain distance 1.0 H. A wing angle of the second blade section A2 may become an angle W2 between a camber line C2 of the second blade section A2 and a tangent line passing the trailing end T2 of the second blade section A2. The wing angle of the second blade section A2 may be smaller than that of the first blade section S1 (W2<W1).

An appropriate parallel surface may be taken between the first parallel surface S1 and the second parallel surface S2. In the illustrated embodiment, a third parallel surface S3 spaced from the main plate 10 by a distance 0.5 H will be taken.

Now, a third blade section A3 having a wing angle W3 between the wing angles W1 and W2 may be formed on the third parallel surface S3. Here, in order to exactly define the location of the third blade section A3 on the third parallel surface S3, a leading edge function may be obtained through appropriate interpolation using coordinates of a leading end L1 of the first blade section A1 and a leading end L2 of the second blade section A2, and a point L3 where a leading edge line LE0 formed by the leading edge function meets the third parallel surface S3 may be obtained. Here, the interpolation refers to obtaining a function of connecting discrete points from known discrete points.

The interpolation for obtaining the leading edge function may be performed using a polynomial expression or a logarithmic expression. For example, the leading edge function defining the leading edge line LE0 may be obtained by interpolation from coordinates of the leading end L1 of the first blade section A1 and the leading end L2 of the second blade section A2 in a coordinate system where a chord of the first blade section A1 is set to the x-axis, an axis crossing the x-axis on the first parallel surface S1 is set to the y-axis, and an axis crossing the first parallel surface S1 is set to the z-axis.

Similarly, a trailing edge function may be obtained through appropriate interpolation using coordinates of a trailing end T1 of the first blade section A1 and a trailing end T2 of the second blade section A2, and a trailing end T3 of the third blade section A3 where a trailing edge line TE formed by the trailing edge function meets the third parallel surface S3 may be obtained.

Here, the leading edge function and the trailing edge function may be functions determined by various methods through interpolation using a polynomial expression and a logarithmic expression as described above, in which the wing angle W3 of the third blade section falls between the wing angle W2 of the second blade section and the wing angle W1 of the first blade section (W2<w3<W1).

The locations of the leading end L3 and trailing end T3 of the third blade section A3 to be taken from the third parallel surface S3 may be determined by the above process. Here, the locations of the leading ends L3 and trailing end T3 of the third blade section A3 have been obtained through the leading edge function obtained by interpolating the leading ends L1 and L2 of the first and second blade sections A1 and A2 and the trailing edge function obtained by interpolating the trailing ends T1 and T2 of the first and second blade sections A1 and A2, but embodiments are not limited thereto. For example, it is possible to determine the locations of the leading end L3 and the trailing end T3 on the third parallel surface S3 by taking more parallel surfaces between the first blade section A1 and the second blade section A2, obtaining coordinates of more leading edges and trailing ends by choosing points determining the locations of the leading and trailing ends on the respective parallel surfaces, and using the leading edge function and the trailing edge function obtained by interpolating between the respective coordinates. Even in this case, however, the leading edge function and the trailing edge function may be obtained within a range where the wing angle becomes smaller as the blade section on the parallel surface becomes more distant from the main plate 10.

For example, parallel surfaces may be taken every 0.1 h distance from the main plate 10, and at least three of the parallel surfaces. In this case, points defining the leading ends and the trailing ends of the blade sections on the respective parallel surfaces may be taken such that the wing angle becomes smaller as the blade section becomes more distant from the main plate 10, and then the leading edge function connecting the respective leading end points and the trailing edge function connecting the respective trailing end points may be obtained by interpolation.

If the leading end L3 and the trailing end T3 of the third blade section A3 to be taken from the third parallel surface S3 are determined by the above process, blades may be formed according to comparative embodiments shown in FIGS. 4 and 5.

However, the blade 30 of the turbo fan 1 may have a different configuration from the blade 40 of the comparative embodiment. To this end, the third blade section A3 may be rotated about a center line Z2 passing the trailing end T3 of the third blade section A3 and crossing the third parallel surface S3 by certain angles in a counterclockwise direction as shown in FIG. 4. Now, the wing angle of the third blade section A3 may increase from W3 to W3', and the location of the leading end L3' of the third blade section A3 may be biased in the opposite direction to the rotational direction of the main plate 10 compared to the location of the leading end L1 of the first blade section A1. Here, W3' may have a greater value than W1.

Through the above process, the location of the leading end of the third blade section A3 may move from L3 to L3' as shown in FIGS. 4 and 6. A leading edge function connecting the leading end L1 of the first blade section A1, the leading end L2 of the second blade section A2, and the leading end L3' of the third blade section A3 may be obtained by interpolation. Now, a leading edge line LE obtained by the leading edge function connecting the leading end L1 of the first blade section A1, the leading end L2 of the second blade section A2, and the leading end L3' of the third section A3 becomes the leading end 31 of the blade 30.

So far, the shape of the blade 30 of the turbo fan 1 has been defined through the process for forming the blade 30.

Hereinafter, the shape of the blade 30 will be defined through detailed description on the blade geometry.

As shown in FIGS. 4 and 6, the blades have the blade sections A1, A2 and A3 cut respectively by a plurality of surfaces S1, S2 and S3 parallel to the main plate 10. The blade section A1 cut by the first parallel surface S1 may have the wing angle W1, and the blade section A2 cut by the second parallel surface S2 may have the wing angle W2. Also, the blade section A3' cut by the third parallel surface S3 may have the wing angle W3'.

Here, the blade 30 may be formed with a backward curve in which the trailing edge 32 of the blade 30 is more biased in the opposite direction to the rotational direction of the turbo fan 1 than the leading edge 31 of the blade 30. Also, the first blade section A1 formed on the main plate 10 may have a relatively greater wing angle (e.g., W1 is equal to about 45 degrees), and the second blade section A2 adjacent to the shroud 20 may have a relatively smaller wing angle (e.g., W2 is equal to about 30 degrees).

Also, the leading end L2 of the second blade section A2 may be formed at a location more biased in the rotational direction of the main plate 10 than the leading end L1 of the first blade section A1. In contrast, the trailing end T2 of the second blade section A2 may be formed at a location more biased in the opposite direction to the rotational direction of the main plate 10 than the trailing end T1 of the first blade section A1. Due the above structure, the length of the camber line C2 of the second blade section A2 may be longer than that of the camber line C1 of the first blade section A1, thereby securing a broader contact area with air and facilitating a positive pressure rise compared to the comparative embodiment 40.

Also, the wing angle W2 of the blade section A2 relatively adjacent to the shroud 20 may have a smaller value than that of the wing angle W1 of the first blade section A1 on the main plate 10. Accordingly, a vortex may be reduced between the shroud 20 and the blade 30, and a noise may be inhibited. In addition, flow on the shroud 20 and the main plate 10 may become uniform.

Also, the wing angle W3' of the third blade section A3' may have a value between the wing angle W2 of the second blade section A2 and the wing section W1 of the first blade section A1. The leading end L3' of the third blade section A3' may be formed at a location more biased in the opposite direction to the rotational direction of the main plate 10, compared to the leading end L1 of the first blade section A1. Accordingly, the leading edge 31 of the blade 30 may be formed to have a curved shape convex in the opposite direction to the rotational direction of the main plate 10.

Otherwise, the wing angle W3' of the third blade section A3' may have a greater value than the wing angle W1 of the first blade section A1. Even in this case, the leading end L3' of the third blade section A3' may be formed at a location more biased in the opposite direction to the rotational direction of the main plate 10, compared to the leading end L1 of the first blade section A1.

Since the leading edge 31 of the blade 30 may have a curved shape convex in the opposite direction to the rotational direction of the main plate 10, an area of the positive pressure surface 33 of the blade 30 may be broadened, and a positive pressure rise may be achieved without a reduction of airflow suctioned between the blades 30.

On the other hand, one end of the blade 30 may be substantially perpendicularly connected to the main plate 10, and the shroud connection portion 35 connected to the shroud 20 may also be substantially perpendicularly connected to the shroud 20. In this configuration, generation of a vortex may be minimized at a connection portion of the blade 30 and the main plate 10, or a connection portion of the blade 30 and the shroud 20, and noise may be reduced.

Also, a plurality of grooves 36 may be formed on the positive surface 33 of the blade 30 parallel to the main plate 10. Since air may be guided by the grooves 36 to be uniformly discharged, air-blowing efficiency may be improved.

Figure 7:
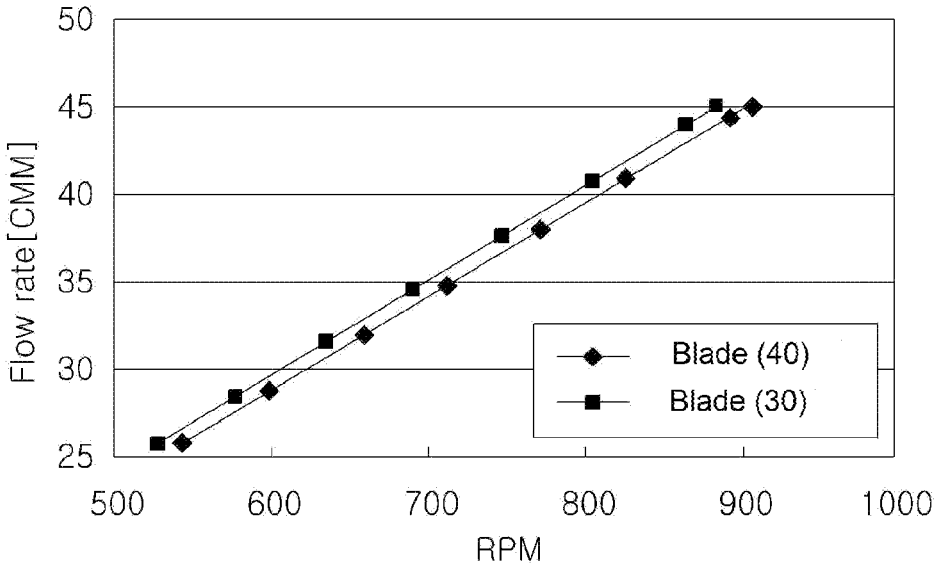
FIG. 7 is a graph illustrating a flow rate with respect to revolutions per minute (rpm) of a turbo fan according to the embodiment of FIG. 1 and the comparative embodiment of FIG. 5.

FIG. 7 is a graph illustrating a flow rate with respect to revolutions per minute (rpm) of a turbo fan according to the embodiment of FIG. 1 and the comparative embodiment of FIG. 5. Referring to FIG. 7, a turbo fan shows a higher flow rate at the same rpm than that of blade 40 of the comparative embodiment shown in FIG. 5.

The turbo fan may increase positive pressure without a reduction of flow rate at the same rpm.

Also, the turbo fan may broaden a contact area with air without increasing the length of the blade, and therefore may increase a positive pressure while securing sufficient flow rate.

Also, the turbo fan may allow a flow state to be uniform at the sides of the shroud and hub.

Figure 8:
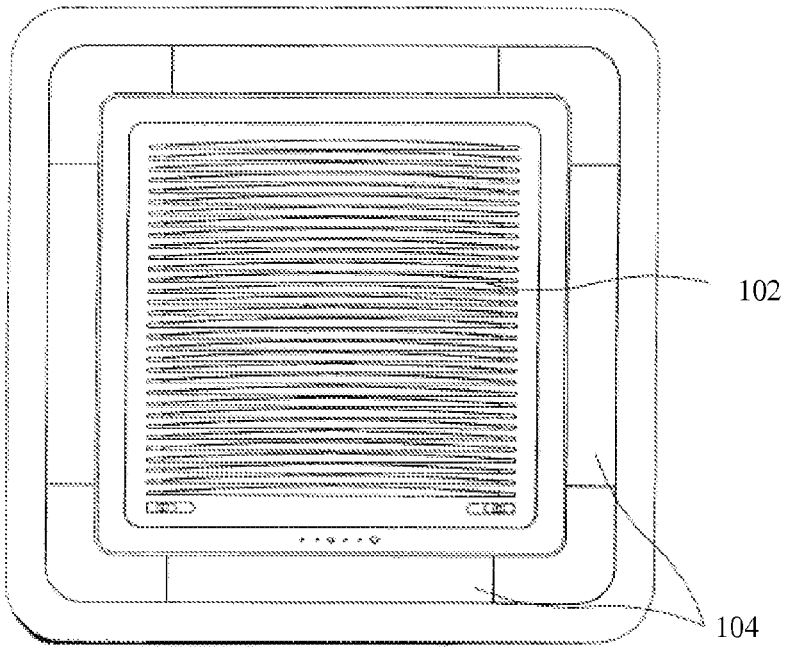
FIG. 8 is a bottom view of an air conditioner including the turbo fan of FIG. 1.
Figure 9:
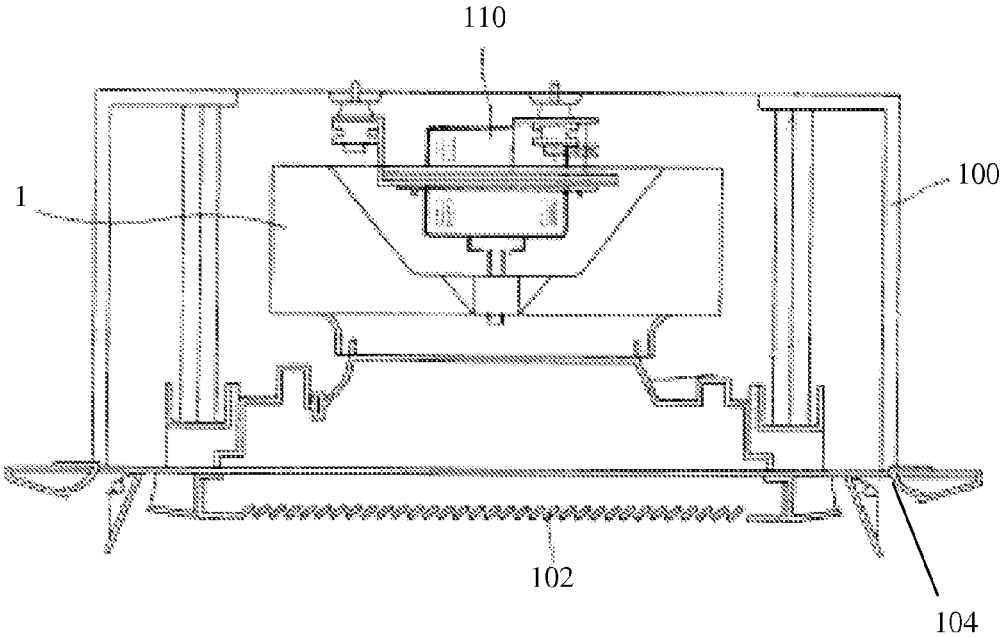
FIG. 9 is a longitudinal section of the air conditioner of FIG. 8.

FIG. 8 is a bottom view of an air conditioner including the turbo fan of FIG. 1. FIG. 9 is a longitudinal section of the air conditioner of FIG. 8. Although details of the exemplary air conditioner are described below, it will be understood that the turbo fan may be used with various other air conditioner configurations.

Referring to FIGS. 8 and 9, the air conditioner may include a housing 100 including a suction port 102 and exhaust ports 104. The air may be sucked into the air conditioner through the suction port 102, cooled or heated using a heat exchanger (not shown) and then exhausted through the exhaust ports 104.

The air conditioner may include a driving motor 110 for generating a rotation force and a turbo fan 1 coupled to a rotation shaft of the driving motor 110, so that the air may be sucked into the air conditioner by rotation of the turbo fan 1.

In the case using the turbo fan including blades 30, the turbo fan has a higher flow rate at the same rpm than that of the turbo fan including blades 40 of the comparative embodiment. Thus, more air may pass through the heat exchanger and the rate of heat absorption or heat discharge may be increased in the air conditioner.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A turbo fan, comprising:

a main plate for rotation in a rotational direction about a rotational axis; and a plurality of blades arranged at intervals around the rotational axis of the main plate, at least one blade including:

a first blade section having a leading end and a trailing end;

a second blade section having a leading end and a trailing end, wherein the first blade section is between the main plate and the second blade section; and a third blade section having a leading end and a trailing end, wherein the third blade section is between the first blade section and the second blade section, wherein the leading end of the third blade section is disposed more towards a negative pressure side of the blade than the leading end of the first blade section, and wherein the trailing end of the first blade section is disposed more towards the rotational direction than the trailing end of the second blade section.

2. The turbo fan of claim 1, wherein the leading end of the third blade section is disposed more towards the negative pressure side of the blade than a negative pressure surface of the first blade section.

3. The turbo fan of claim 1, wherein the leading end of the second blade section is disposed more towards the positive pressure side of the blade than the leading end of the first blade section.

4. The turbo fan of claim 3, wherein the leading end of the second blade section is disposed more towards the positive pressure side of the blade than a positive pressure surface of the first blade section.

5. The turbo fan of claim 1, wherein the first blade section is on the main plate.

6. The turbo fan of claim 1, wherein a first wing angle of the first blade section is greater than a second wing angle of the second blade section.

7. The turbo fan of claim 6, wherein a third wing angle of the third blade section is greater than the first wing angle.

8. The turbo fan of claim 1, wherein a distance between the leading end of the third blade section and the rotational axis is less than a distance between the leading end of the first blade section and the rotational axis.

9. The turbo fan of claim 8, wherein a distance between the leading end of the second blade section and the rotational axis is greater than the distance between the leading end of the first blade section and the rotational axis.

10. The turbo fan of claim 1, wherein a portion of the blade near the main plate is substantially perpendicular to the main plate.

11. The turbo fan of claim 1, further comprising a shroud coupled to the blade.

12. The turbo fan of claim 11, wherein the shroud has an air inlet at a center thereof.

13. The turbo fan of claim 11, wherein the shroud has a curved inner surface.

14. The turbo fan of claim 13, further comprising a shroud connection portion contacting the blade and the curved inner surface of the shroud.

15. The turbo fan of claim 14, wherein the shroud connection portion is substantially perpendicular to the inner surface of the shroud.

16. The turbo fan of claim 1, further comprising a plurality of grooves substantially parallel to the main plate and formed on the positive pressure surface of the blade.

17. A turbo fan, comprising:

a main plate for rotation in a rotational direction about a rotational axis; and a plurality of blades arranged at intervals around the rotational axis of the main plate, at least one blade including:

a first blade section having a leading end and a trailing end;

a second blade section having a leading end and a trailing end, wherein the first blade section is between the main plate and the second blade section; and a third blade section having a leading end and a trailing end, wherein the third blade section is between the first blade section and the second blade section, wherein the leading end of the third blade section is disposed more towards a negative pressure side of the blade than the leading ends of the first blade section and the second blade section, and wherein the trailing end of the third blade section is disposed between the trailing end of the first blade section and the trailing end of the second blade section in the rotational direction.

18. An air conditioner, comprising:

a housing;

a turbo fan in the housing;

a motor for rotating the turbo fan; and a heat exchanger for heating or cooling air sucked into the housing by the turbo fan, wherein the turbo fan comprises:

a main plate for rotation in a rotational direction about a rotational axis; and a plurality of blades arranged at intervals around the rotational axis of the main plate, at least one blade including:

a first blade section having a leading end and a trailing end;

a second blade section having a leading end and a trailing end, wherein the first blade section is between the main plate and the second blade section;

a third blade section having a leading end and a trailing end, wherein the third blade section is between the first blade section and the second blade section, wherein the leading end of the third blade section is disposed more towards a negative pressure surface side of the blade than the leading end of the first blade section, and wherein the trailing end of the first blade section is disposed more towards the rotational direction than the trailing end of the second blade section.

* * * * *